US007382262B2

(12) United States Patent
Commagnac et al.

(10) Patent No.: US 7,382,262 B2
(45) Date of Patent: Jun. 3, 2008

(54) SYSTEM AND METHOD OF TAMPER DETECTION

(75) Inventors: Francois Commagnac, Nice (FR); Jean-Christophe Mestres, Vence (FR); Joaquin Picon, St Laurent du Var (FR); Pierre Secondo, Tourrettes sur Loup (FR)

(73) Assignee: International Business Machines Corporation, Armonk, NY (US)

( * ) Notice: Subject to any disclaimer, the term of this patent is extended or adjusted under 35 U.S.C. 154(b) by 10 days.

(21) Appl. No.: 11/406,911

(22) Filed: Apr. 19, 2006

(65) Prior Publication Data

US 2006/0238341 A1 Oct. 26, 2006

(30) Foreign Application Priority Data

Apr. 20, 2005 (EP) ..... 05300300

(51) Int. Cl.
*G08B 13/14* (2006.01)

(52) U.S. Cl. ..... 340/572.1; 340/572.3; 340/572.8

(58) Field of Classification Search ..... 340/572.1, 340/572.3, 572.7, 572.8, 568.2, 652
See application file for complete search history.

(56) References Cited

U.S. PATENT DOCUMENTS

| | | | | |
|---|---|---|---|---|
| 5,111,184 | A | 5/1992 | Heaton et al. | |
| 5,512,879 | A * | 4/1996 | Stokes | 340/572.8 |
| 5,541,577 | A * | 7/1996 | Cooper et al. | 340/551 |
| 5,646,592 | A * | 7/1997 | Tuttle | 340/568.2 |
| 6,031,457 | A * | 2/2000 | Bonkowski et al. | 340/572.1 |
| 6,137,413 | A * | 10/2000 | Ryan, Jr. | 340/572.8 |
| 6,271,753 | B1 * | 8/2001 | Shukla | 340/572.8 |
| 6,275,157 | B1 | 8/2001 | Mays et al. | |
| 6,662,642 | B2 * | 12/2003 | Breed et al. | 340/447 |
| 6,720,866 | B1 | 4/2004 | Sorrells et al. | |
| 7,042,357 | B2 * | 5/2006 | Girvin et al. | 340/568.2 |
| 7,098,794 | B2 * | 8/2006 | Lindsay et al. | 340/572.3 |
| 7,119,690 | B2 * | 10/2006 | Lerch et al. | 340/572.1 |
| 7,151,455 | B2 * | 12/2006 | Lindsay et al. | 340/572.3 |
| 7,176,796 | B2 * | 2/2007 | Chen et al. | 340/572.1 |
| 2003/0099158 | A1 * | 5/2003 | De la Huerga | 368/10 |
| 2004/0066296 | A1 * | 4/2004 | Atherton | 340/572.1 |

FOREIGN PATENT DOCUMENTS

| | | | |
|---|---|---|---|
| CA | 2417616 | A1 | 2/2002 |
| CN | 1118910 | A | 3/1996 |
| JP | 2003141649 | A | 5/2003 |
| WO | 02077939 | A1 | 10/2002 |

* cited by examiner

*Primary Examiner*—John Tweel, Jr.
(74) *Attorney, Agent, or Firm*—Norman L. Gundel; Hoffman, Warnick & D'Alessandro LLC

(57) ABSTRACT

The present invention relates to a system and method of tamper detection. A tamper detection system in accordance with an embodiment of the present invention includes: a passive electronic sensor including a circuit having first, second, and third nodes; a load connected between the first and second nodes of the circuit; a friable electrical connection element connected between the second and third nodes of the circuit; and a storage unit, connected to the second node of the circuit, for storing an identification code of the sensor; wherein in use a voltage is applied across the first and third nodes of the circuit, and when the friable electrical connection element is intact, the second node of the circuit is at a first voltage, and when the friable electrical connection element is broken, the second node of the circuit is at a second voltage.

4 Claims, 2 Drawing Sheets

SYSTEM AND METHOD OF TAMPER DETECTION

FIELD OF INVENTION

The present invention relates to a system and method of tamper detection and in particular, to a system and method employing a radio frequency identification (RFID) tag.

BACKGROUND ART

Recent studies have shown that, at present, 80% of the pharmaceuticals being globally developed are biological products such as bio-therapeutic agents (e.g., vaccines) or biological supplies/samples (e.g., blood, serum etc.). These products typically cost ten times more than traditional products to handle during manufacture and transport through the supply chain. These additional costs arise because biological products are often sensitive to environmental conditions and thus require specialised handling. For instance, many biological products (e.g., enzymes) are temperature-sensitive and must be handled and stored at low temperatures. Similarly, other biological products are sensitive to the presence of oxygen or other ambient gases. Consequently, these products must be handled and stored in an air-free environment. If a biological product is exposed to a particular environmental condition or agent during manufacture, storage or transport, the biological product may react therewith and decay more rapidly than predicted by its official expiration date. Consequently, the safety of such products is brought into doubt.

To further complicate the matter, biological products are typically transported in smaller quantities than traditional products. It is also envisaged that even smaller quantities of these products will be routinely transported in the future. Consequently, a major problem facing the pharmaceutical industry is improving control over the handling of biological products whilst lowering their overall transport cost.

Security seals can be roughly divided into three types, namely tamper-evident seals, barrier seals and electronic seals. Tamper-evident seals do not secure items against tampering. Instead, a tamper-evident seal provides evidence of ingress or contamination of an item to which it is attached. Tamper-evident seals are typically simple seals such as frangible foils or films, crimped cables or other (theoretically) irreversible mechanical assemblies. Tamper detection is typically based on a manual inspection of the tamper evident seal. However, whilst this process is acceptable for a small number of items, it is not practical or reliable for a large number of items.

In contrast with tamper-evident seals, electronic security seals actively monitor for tampering and provide a real-time alert in the event that tampering occurs. Consequently, electronic security seals facilitate rapid, convenient and cost-effective control over the handling and storage of an item without requiring manual intervention.

Electronic security seals typically require a source of power. For instance, U.S. Pat. No. 5,111,184 describes a device in which a fiber optic cable is connected between a fixed member and a movable member of a container so that the cable is bent when the container is opened and closed. Light pulses are transmitted through the cable and variations in the pulses resulting from bending of the cable are detected to indicate the opening and closing of the container. The device in U.S. Pat. No. 5,111,184 is powered by a battery pack. However, the inclusion of a power supply in an electronic security seal increases the cost, size and weight of the seal.

Passive RFID tags do not have their own power supply. Instead, these devices possess an antenna that captures the power from an incoming radio-frequency (RF) scan (in the form of a minute electrical current induced in the antenna). This provides enough power for the tag to send a response to the received RF scan. Since a passive RFID tag does not need its own power supply, a tag can be designed with very small dimensions. For instance, U.S. Pat. No. 6,275,157 describes an RFID transponder that is embedded in the glass of a vehicle windshield.

U.S. Pat. No. 6,720,866 describes an RFID tag device with a sensor input adapted to receive variable signals from a switch(es), an analog variable or a digital variable. Whilst the device described in U.S. Pat. No. 6,720,866 could be adapted to include a sensor specifically designed to detect the opening of a container, it would also be necessary to include several logic circuits to handle the signals therefrom. However, the inclusion of these logic circuits would make the device quite complex and thus expensive to manufacture.

WO02095655 describes a tamper-indicating label comprising a tamper track coupled to an RFID component. In one embodiment, the adhesion characteristics of the tamper track are adapted to break apart the tamper track when the label is tampered with. In a similar vein, CA2417616 describes a tamper-indicating RFID label designed to permit the destruction of the label in the event of an attempt to remove the label from a surface. In particular, an adhesion modifying coating is applied to portions of the label to affect the relative adhesion strength therebetween and thereby enable differential separation of the label from a surface in the event of an attempt to remove the label therefrom.

Systems such as those described in CA2417616 and WO02095655 could be used to detect the removal of a container cap by applying the label to the container so that one part of the label is attached to the cap and the other part is attached to the container. With this arrangement, the label must be peeled off the container in order to remove the cap. However, these systems detect the removal of the label, rather than the specific operation of opening the container. Consequently, these systems may be less secure than a system based on the direct detection of the opening of a container. On the other hand, a very complex label manufacturing and fixing process would be needed to enable the direct (absolute) detection of container opening.

SUMMARY OF THE INVENTION

The present invention is directed to a system and method of tamper detection.

More particularly, the present invention discloses a tamper detection system comprising: a passive electronic sensor including a circuit having first, second, and third nodes; a load connected between the first and second nodes of the circuit; a friable electrical connection element connected between the second and third nodes of the circuit; and a storage unit, connected to the second node of the circuit, for storing an identification code of the sensor; wherein in use a voltage is applied across the first and third nodes of the circuit, and when the friable electrical connection element is intact, the second node of the circuit is at a first voltage, and when the friable electrical connection element is broken, the second node of the circuit is at a second voltage.

Advantages of this invention are set out in detail in the description.

In particular, the present invention provides a means of improving control over the handling of a sensitive product by making it possible to remotely and automatically interrogate (without requiring visual inspection of) containers of the product to determine whether the containers have been tampered with. This facilitates rapid container integrity checking and leads to improved product safety because traditional mechanisms of determining whether a product has been tampered with are often prone to human error.

Other advantages and aspects of the invention can be seen in the accompanying claims and description.

BRIEF DESCRIPTION OF THE DRAWINGS

Reference will now be made by way of example, to the accompanying drawings in which:

FIG. 1(*b*) is a perspective view of the tamper detector attached to an opened container;

FIG. 2(*b*) is a circuit/logic diagram of the register in the tamper detector of FIG. 1(*b*).

DETAILED DESCRIPTION OF THE INVENTION

Figure 1B:
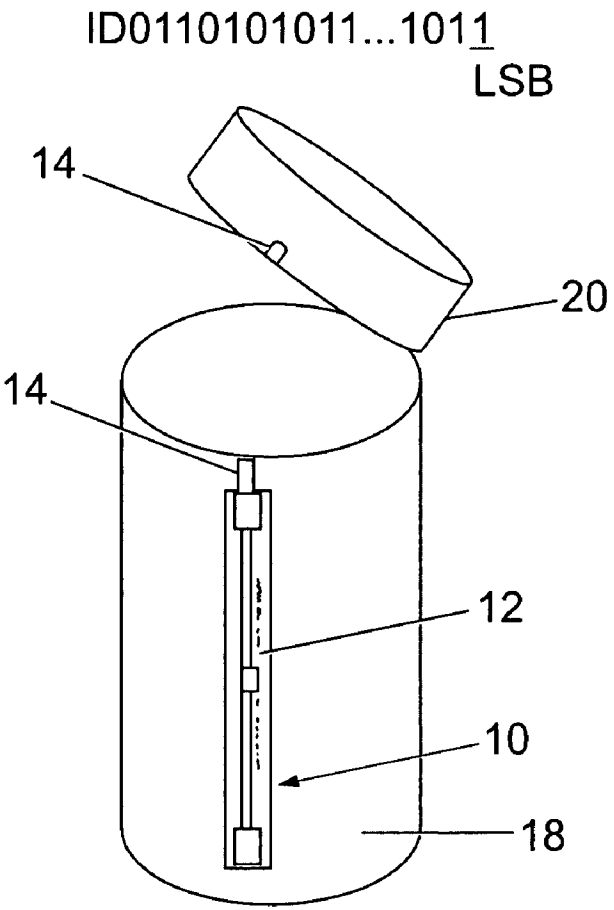
FIG. 1(*a*) is a side elevation view of the tamper detector attached to an unopened container.
Figure 1A:
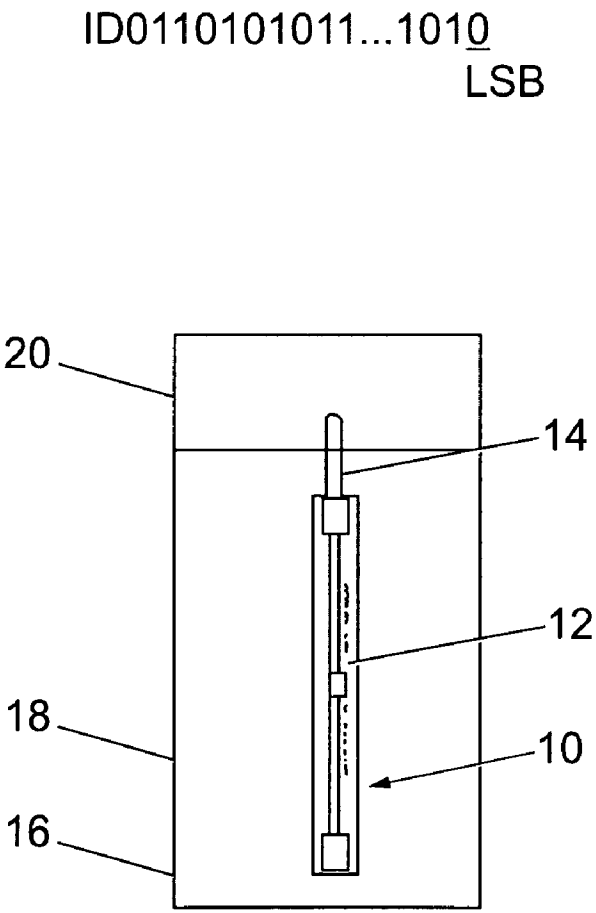

Referring to FIG. 1(*a*) the tamper detector 10 comprises an RFID tag 12 with a memory register and an external circuit in the form of a thin wire loop 14 coupled to the least significant bit (LSB) of the memory register. In use, the tamper detector 10 is attached to a container 16 comprising a first portion 18 being open at one end, and a cap 20 that is fittable over the open end of the first portion 18 to close the container 16.

The tamper detector 10 is attached to the container 16 in an arrangement in which the RFID tag 12 is stuck to (or embedded in) the first portion 18 and the thin wire loop 14 is attached to the cap 20. The thin wire loop 14 may be attached to the cap 20 by any of a variety of methods extending from simple adhesion with appropriate glue to inclusion of the thin wire loop 14 into a hole in the cap 20, which is then sealed using an epoxy-like cement. Referring to FIG. 1(*b*), with this arrangement, in the event of an attempt to tamper with the container 16, the movement of the cap 20 (necessary to open the container 16) causes the thin wire loop 14 attached thereto to be broken.

Figure 2A:
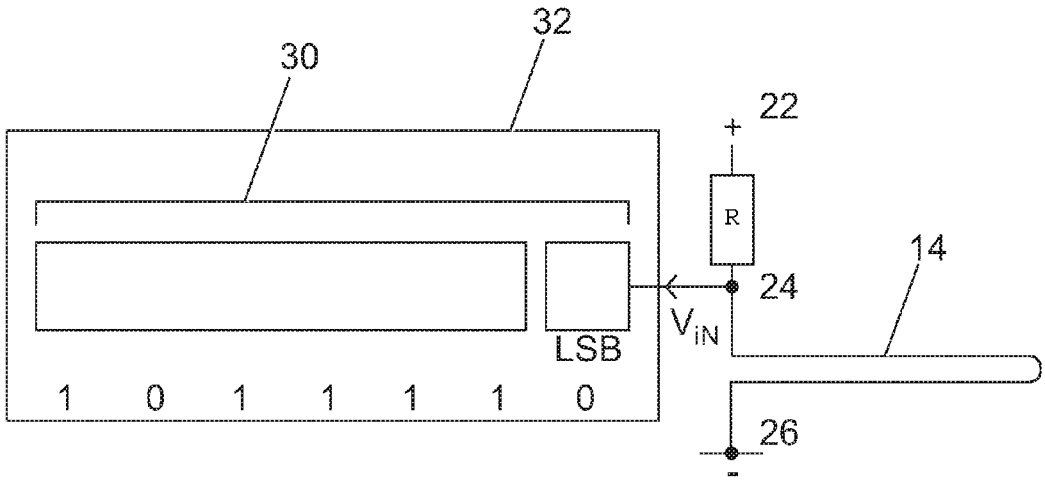
FIG. 2(*a*) is a circuit/logic diagram of a register in the tamper detector of FIG. 1(*a*)
Figure 2B:
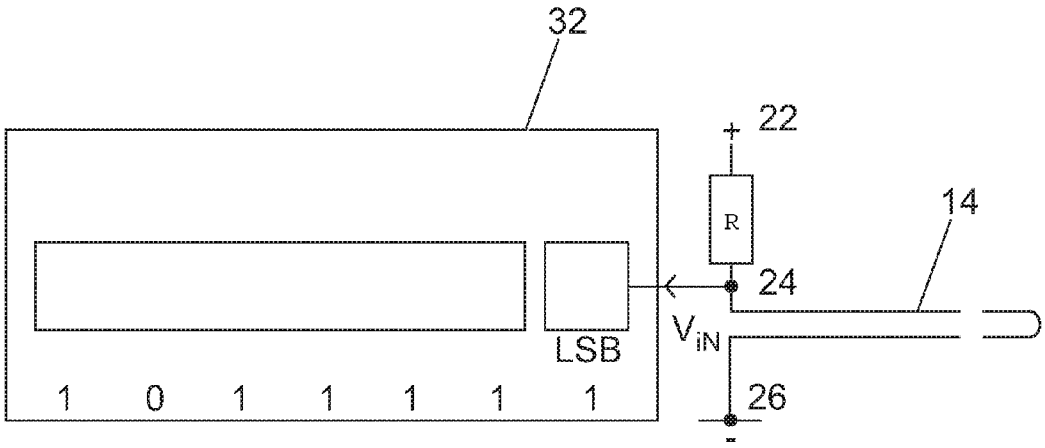

Referring to FIG. 2(*a*) the RFID tag 12 comprises a circuit having three nodes 22, 24 and 26. The RFID tag's antenna is connected to a load resistor R and the load resistor is in turn connected between nodes 22 and 24. An RFID tag can be identified by means of its ID number 30 which is generally stored in a memory (EEPROM or FRAM) in the RFID tag 12, and transferred to the tag's memory register 32 (on receipt of an incoming RF signal) for subsequent transmission to a reader (not shown). In the present case, the least significant bit (LSB) of the tag's memory register 32 is connected to node 24.

When the container is closed for the first time and sealed with the tamper detector, the thin wire loop 14 forms an electrical connection with the RFID tag 12, wherein the thin wire loop 14 is connected between nodes 24 and 26, to connect the voltage induced in the RFID tag's antenna (by an incoming RF signal) to ground. Accordingly, the electrical connection formed by the intact thin wire loop 14 ensures that the voltage setting the LSB of the tag's memory register has a low-level. This results in an even tag ID number 30.

However, referring to FIG. 2(*b*), if the container is opened, the thin wire loop 14 and the electrical connection with the RFID tag 12 is broken (i.e., the voltage induced in the tag's antenna is not connected to ground). Consequently, the voltage setting the LSB of the tag's memory register 32 attains a high value. As a result, the tag ID number becomes an odd number.

In summary, a container's RFID tag answers a reader with an even identification code number after being closed for the first time and an odd number if the container has been opened. In other words, the breaking of the thin wire loop 14 modifies the response returned by the RFID tag 12 when read, so that, even if the container is reassembled into its original state, the tag will still report the opening of the container.

While the invention has been particularly shown and described with reference to a preferred embodiment, it will be understood that various changes in form and detail may be made therein without departing from the spirit and scope of the invention.

The invention claimed is:

1. Method of detecting tampering with an item comprising a first member and a second member being movable relative to the first member, the method comprising the steps of:

attaching a passive electronic sensor to the first member, the passive electronic sensor comprising a load and a storage unit for storing a sensor identification code of the sensor;

attaching a first end of a friable electrical connection element to the second member;

forming a series connection between the second end of the friable electrical connection element and the load; and connecting the storage unit to the series connection at a position between the second end of the friable electrical connection element and the load, so that movement of the second member relative to the first member causes the friable electrical connection element to break and thereby alter the sensor identification code stored in the storage unit.

2. Method of detecting tampering with a container comprising the steps of:

attaching a passive electronic sensor to a first member of the container, the passive electronic sensor including a circuit having first, second, and third nodes, wherein a load is connected between the first and second nodes of the circuit, and wherein a storage unit for storing an identification code of the sensor is connected to the second node of the circuit;

attaching a first end of a friable electrical connection element to a closing member of the container, wherein the closing member is movable relative to the first member;

connecting the friable electrical connection element between the second and third nodes of the circuit;

applying a voltage across the first and third nodes of the circuit so that when the friable electrical connection element is intact, the second node of the circuit is at a first voltage, and wherein movement of the closing member relative to the first member of the container causes the friable electrical connection element to break setting the second node of the circuit to a second voltage.

3. Method as claimed in claim 2 wherein the first end of a friable electrical connection element is adhesively attached to the closing member of the container.

4. Method as claimed in claim 2 wherein the first end of the friable electrical connection element is attached to the closing member of the container by:

forming a hole in the closing member;

inserting the first end of the friable electrical connection element into the hole; and fixing the first end of the friable electrical connection element in the hole.

* * * * *